United States Patent [19]

Boben

[11] Patent Number: 5,046,588

[45] Date of Patent: Sep. 10, 1991

[54] CAM-OPERATED RAIL CLAMP

[76] Inventor: Ronald Boben, 503 N. Ingleside, Fairhope, Ala. 36532

[21] Appl. No.: 582,669

[22] Filed: Sep. 14, 1990

[51] Int. Cl.[5] ..... B61H 7/12

[52] U.S. Cl. ..... 188/41; 188/67

[58] Field of Search ..... 188/41, 42, 43, 67; 212/110, 122

[56] References Cited

U.S. PATENT DOCUMENTS

| | | | |
|---|---|---|---|
| 3,759,189 | 9/1973 | Desilets | 188/43 X |
| 4,007,815 | 2/1977 | Acre | 188/67 X |
| 4,262,811 | 4/1981 | Montague | 212/122 X |

FOREIGN PATENT DOCUMENTS

| | | | |
|---|---|---|---|
| 1481776 | 4/1969 | Fed. Rep. of Germany | 212/122 |
| 54-1562 | 1/1979 | Japan | 188/41 |
| 261442 | 1/1970 | U.S.S.R. | 188/41 |

*Primary Examiner*—Robert J. Spar
*Assistant Examiner*—Craig Slavin
*Attorney, Agent, or Firm*—George A. Bode

[57] ABSTRACT

A cam operated rail clamping device comprising: a base; a vertically disposed post projecting upwardly from the base and secured thereto; a tube rotatably and slidably mounted on the post; a hydraulically operated lift cylinder for raising the tube; a vertically disposed beam extending upwardly from the base and secured thereto; a horizontally disposed flange secured to the lower end of the tube; a clamping jaw carried by the flange and provided with a plurality of teeth for engagement with one side of a rail; a wearing shoe carried by the base for engagement with the other side of the rail; the flange being mounted for rotation about the post to bring the high point of the jaw into wedging action with the rail when the flange engages the top of the rail; and, a set of microswitches for cam positioning.

2 Claims, 3 Drawing Sheets

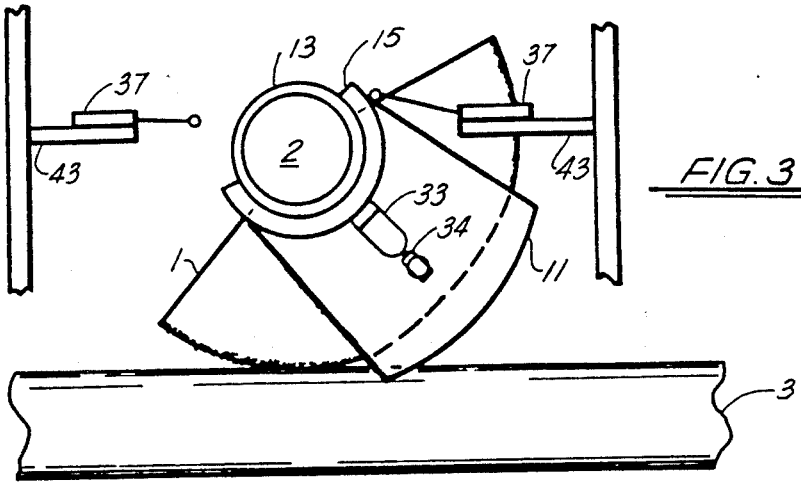
FIG. 3
FIG. 2
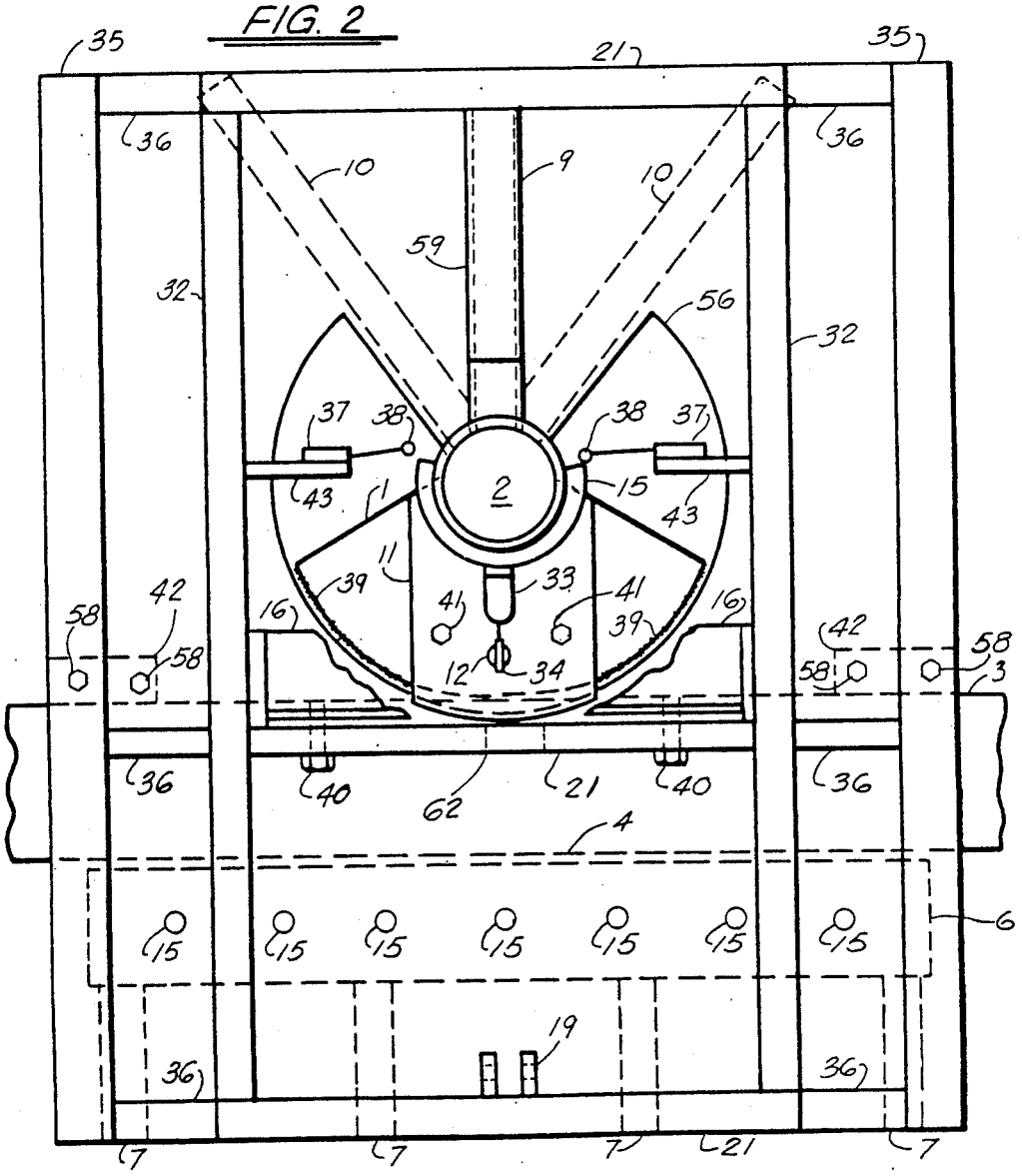

CAM-OPERATED RAIL CLAMP

BACKGROUND OF THE INVENTION

This invention was designed to be used on movable bridges, cranes, stackers, reclaimers and structures that move along rails.

The object of this device is to provide a positive clamping action of a structure to the rail in order to prevent the accidental movement along the rail.

Another object of this invention is to provide a clamping device for fastening any type of structure in place that moves along steel rails and wherein the structure will be secured in place eventhough the rails were wet, icy, oily or greasy. The clamping device being simple to operate and requiring little maintenance, the clamp frame rides on top of the rail to clean the rail of any obstructions such as ice, snow, cargo or debris.

A further objective of this invention is to be simple in nature and inexpensive to maintain and manufacture.

Other objectives and advantages will be apparent during the course of the following description. In the accompanying drawings, forming a part of this application, and in which like numerals are used to designate like parts throughout the same.

BRIEF DESCRIPTION OF THE DRAWINGS

FIG. 2 is a top plan view of the rail clamp, with parts broken away and in section.

FIG. 3 is a fragmentary top plan view of the cam of the rail clamp with parts in section and showing the cam in contact with the rail.

DESCRIPTION OF THE PREFERRED EMBODIMENT

Figure 1:
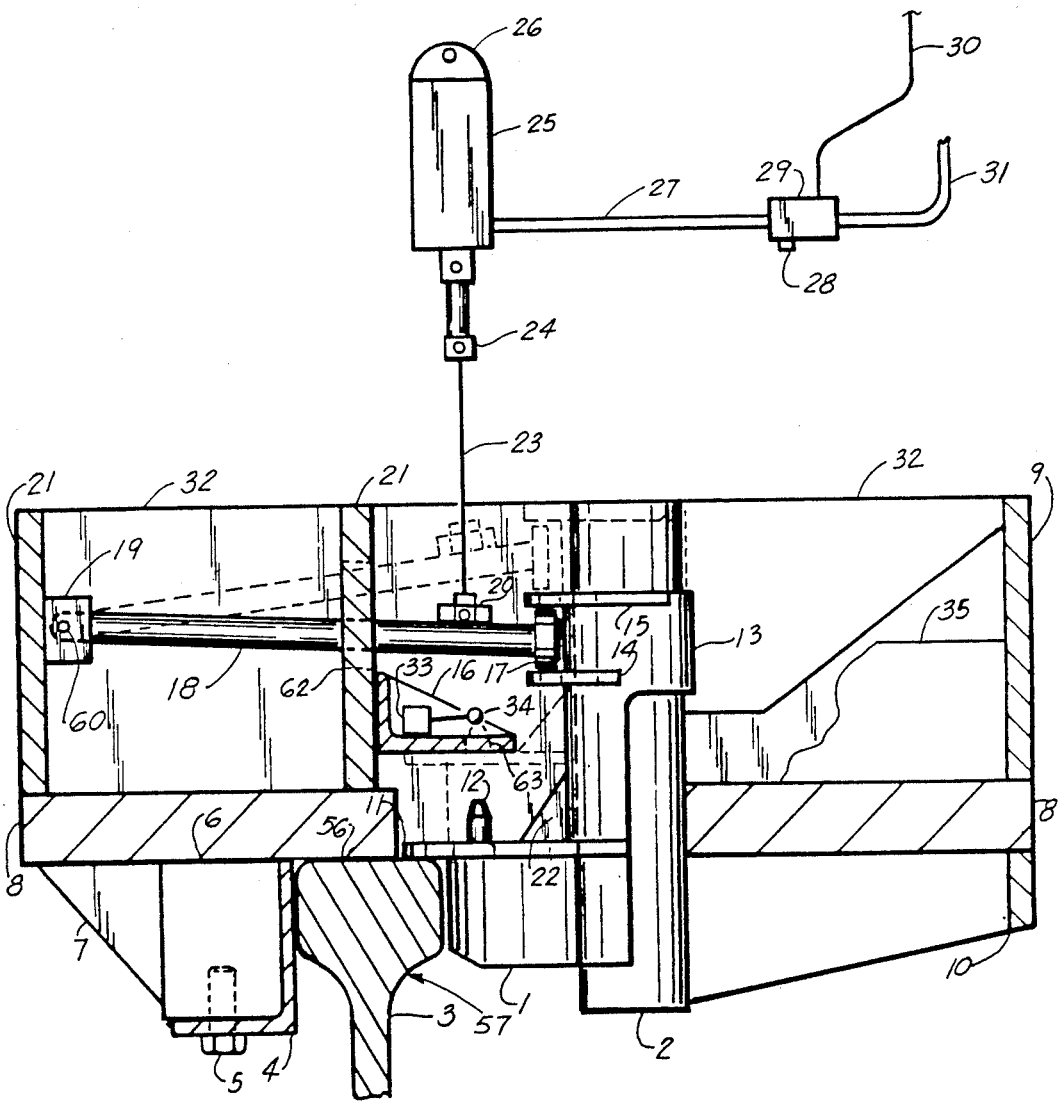
FIG. 1 is a side elevational view of the rail clamp, with part broken away and in section. Also included is a view of an air-operated lift mechanism.
Figure 4:
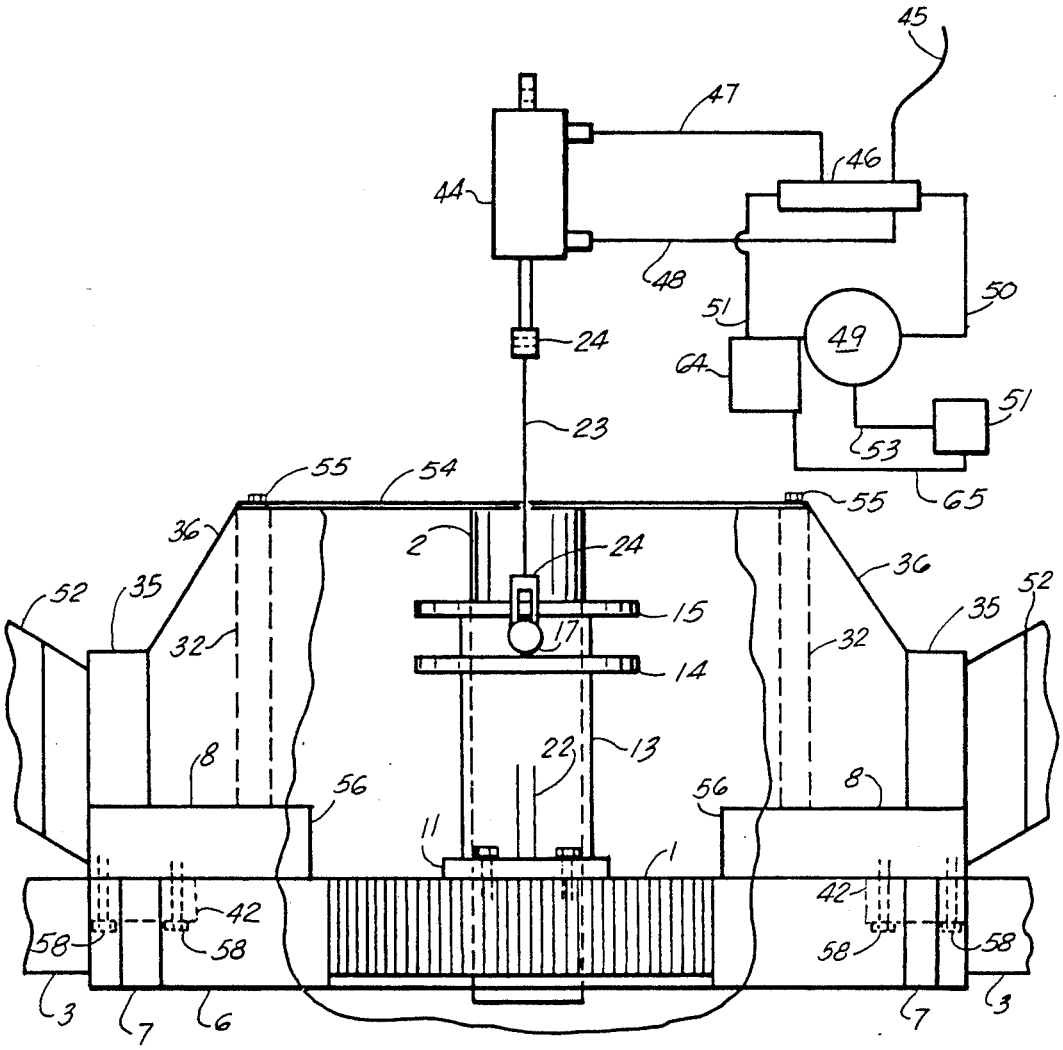
FIG. 4 is a view taken at right angles to the view shown in FIG. 1 and with parts broken away and in section.

Referring in detail to FIGS. 1, 2, and 4 of the drawings, the numeral 8 designates a base which can be made of any suitable material, and the base 8 is provided with a cutout 57 for receiving therein a rail 3, FIG. 1. The rail 3 may form part of a track and the cutout 57 in the base defines a vertical wall 6. Arranged continuous to the wall 6 is a wearing shoe 4. For maintaining the shoe 4 in place, a pair of clamping bars 42 are provided and these clamping bars 42 may be secured to the base by suitable securing elements such as bolts or screws 58. The wearing shoe 4 is adapted to contact one side of the rail 3.

Projecting upwardly from the top of the base 8 and secured thereto is a pair of vertically disposed spaced parallel ribs 32. There is further provided on the top of the base 8, three plates 21 which are at right angles to ribs 32 for the purpose of reinforcing ribs 32 and to provide a backup structure for gussets 36. Also projecting from the top of the base plate 8 are the two bumper bars 35. Their purpose will be described later. Bumper bars 35, gussets 36, ribs 32, reinforcing plate 21 and base 8 are secured to each in a suitable manner, as for example by welding, and are shown in FIGS. 1, 2 and 4.

Projecting upwardly from the top of the base 8 and secured thereto, is the pivot pin 2; upper back up structure 9 which is secured by any suitable means, such as welding, to base 8; and reinforcing plate 21, as shown in FIGS. 1 and 2.

Projecting downward from base 8 are a pair of convergent plates or ribs 10 which meet at a point on pin 2, and a lower backup structure 59, positioned between the plates 10. Extending vertically through the structure is pin 2 which is secured by a suitable means, such as welding, to the base 8; upper backup structure 9; lower backup structure 59 and two convergent braces 10. The post or pin 2 is stationary and provides a support or guide for the rotatable and vertically shiftable tube 13. A horizontally disposed flange 11 is secured to the lower end of the tube 13, FIG. 1. The purpose of the flange 11 is to impart motion to a cam 1 during movement of the clamp by reason of the friction between the flange 11 and the top of the rail 3. The cam or eccentrically pivoted clamping jaw 1 is secured to the under surface of the flange 11 in any suitable manner, as per sample bolts 41. The cam 1 is mounted for swinging movement through an arc, and the cam 1 is movable, mounted in a recess or cutout 56 in the base 8. The cam is provided with a plurality of serrations or teeth 39 which are arranged on the opposite side of the rail 3 from the wearing shoe 4. The top of tube 13, at which point lift flange 15 and guild flange 14 are secured by a suitable means, as for example welding, are used to provide a rotatable device for lifting the cam 1 clear of the rail 3. This will be described in more detail later. Lift flange 15 also provides a contact point for the cam 1, positioning microswitches 37, as in FIGS. 2 and 3. Their function will be explained later.

Attached to flange 11 by a suitable means, such as welding, is a gusset 22 which keeps the tube 13 and cam 1 in proper alignment.

Secured to the base 8 in any suitable manner, as for example by welding, is a pair of bumpers 35. These bumpers 35 are adapted to be engaged by a projecting portion 52 of the structure which may be a movable bridge, crane, stacker, reclaimer or the like that is to be held immobile or stationary on the rails 3, FIG. 4.

Vertical wall 6 is lined with shoe 4, is secured to base 8 by a suitable means, such as welding, and is provided with gussets 7 which are secured to base 8 and vertical wall 6 by means of welding. The surface 56 cooperates with the shoe 4 and guild bars 42 to hold the device in proper position with respect to the rail and also serves to remove foreign matter from the rail.

Referring to FIG. 1 of the drawings, the rail clamping device includes an air operated cylinder 25 for elevating the cam 1. The cam 1 is lifted by means of air from a source 31 entering cylinder 25 by line 27 forcing the piston up, thus giving upward movement to arm 18 transmitted through cable 23. The cable 23 is attached to arm 18 at pivot point 20 and cylinder 25 by means of a clevis 24 on either end of cable 23. Arm 18 is secured to bracket 21 by a suitable means, as is pin 60 and bracket 19 continuing through center bracket 21 by means of cutout 62 to lifting flange 15. Roller 17 on the free moving end of arm 18 will come in contact with flange 15, lifting cam 1 in the raised position, through tube 13 when upward said force is applied by cylinder 25.

The cam 1 will be lowered into the clamp position as shown in FIGS. 1, 2 and 4 when there is a loss of power through electrical supply cable 30. The air valve 29 and its operation will be later described.

FIG. 4 shows the arm 18 providing lift to the cam 1 by means of a hydraulic cylinder 44 which gets its force from a pump 51 which charges an accumulator 49. Oil enters cylinder 44 through line 48 from control valve 46 and pushes up on a piston in cylinder 44, raising cam 1 in the same manner as was described in air operated cylinder 25, in FIG. 1. A more detailed description of the hydraulic operation will later be discussed.

Referring to FIG. 1 of the drawings, a duel purpose centering and stopping bracket 16, which can be secured by any suitable means, is attached to the center brace 21. FIG. 1 shows a pin 12 carried by plate 11. The pin 12 is adapted to project through an aperture or opening 63 in the flange 16 when the flange 11 is in its raised position. Thus, when the pin 12 projects in the opening 63 rotation of the cam 1 is prevented, so that the cam 1 cannot move into locking engagement with the side of the rail 3 opposite from the wearing shoe 4. Once said cam 1 is in the upward position and pin 12 has projected through opening 63, pin 12 will come in contact with roller 34 pushing up on the microswitch 33 arm, sending a signal by any suitable electrical source to the control console of the moveable structure, thus indicating to the moveable structure operator that cam 1 is raised in the proper upward position. This will be discussed further.

In air operated cylinder 25 as shown in FIG. 1 or a hydraulically operated cylinder 44 as shown in FIG. 4 can be used for raising tube 13 and cam 1 above the rail, as when the device is to be shifted to any location along rail 3. Upon activation of valve 29 or valve 46 by a suitable electrical source, cylinder 44 or cylinder 25 will raise tube 13 and cam 1 in its said locked position. Thus, the device can now be moved along rail 3. In using the assembly shown in FIGS. 1, 2 and 4 the clamp is not applied when the device is to be moved along the rail 3. The tube 13 and cam 1 are raised from the solid line position in FIG. 1 to the dotted line position of FIG. 1, which can be done by any suitable means, such as an air operated cylinder 25 or hydraulically operated cylinder 44. When the brake is to be applied or a lose of electrical energy occurs for any reason, the tube and cam will drop by gravity to the solid line position of FIG. 1.

Upon any movement of the assembly, the teeth 39 of the cam 1, having been put into position by flange 11, will engage one side of the rail 3 while the wearing shoe 14 will engage the other side of the rail 3. The teeth 39 will cam or lock against the rail 3, and further movement of the device will be prevented so that a structure being held stationary, such as the structure 52 abutting one of the bumpers 35 in FIG. 4, will be maintained immobile in any desired position.

The tube 13 will rotate on the post 2 and at the same time, one of the microswitch rollers 38 will come in contact with flange 15 and move the microswitch 37 arm to indicate which side of the cam 1 has come into contact with rail 3. This is illustrated in FIG. 3.

Microswitches 37 are secured to plate 43, which are secured by a suitable means to rib 32. Thus, the operator of said structure will be able to identify, by a suitable source such as a light or arrow in the control area, which direction the structure had accidental movement. Thus, the operator could center the cam 1 by travelling the structure in the opposite direction of the indicated accidental travel, putting the cam 1 in position to be lifted if controlled movement of the said structure is needed.

However, when valve 29 of FIG. 1 is relieved of electrical source 30, valve 29 cuts off the air from source from 31 to line 27. Thus, air cylinder 25 which is attached to the structure by clevis 26, is allowed to bleed off by valve 28 at a controlled rate allowing flange 11 to land on top of rail 3 with no further movement of said structure. Tube 13 and cam 1 could be lifted by arm 18 by any suitable electrical energy source 30 to valve 29, which would allow air from source 31 to pass through valve 29 into line 27 pushing piston in cylinder 25 upward.

The hydraulically operated cylinder 44 shown in FIG. 4 would function as described above. If a suitable electrical source 45 were to be no longer supplied, valve 46 would discontinue hydraulic pressure to line 48 and would allow line 47 to be pressurized, thus allowing the tube 13 and cam 1 to fall by gravity into position.

Pump 51 provides required hydraulic pressure to accuilator 49. This kinetic power would be stored in case of a complete loss of electrical energy on the structure. Hydraulic pressure 50 from acculilator 49 would go into valve 46; spent pressure would be returned to tank 64 from which pump 51 would get suction. Thus, to return cam 1 and tube 13 in a raised position, a suitable electrical source would have to be returned to line 45, which would divert hydraulic pressure to line 48, pulling in the upward direction on cable 23, raising tube 13 and cam 1. The use of the air cylinder 25 or the hydraulic cylinder 44 would increase the lift capacity of cam 1 and tube 13, and would also remove debris, snow, ice or cargo that may be resting on the top of cam 1.

In FIG. 1, the pin or peg 12 is so arranged that when cam 1 is raised, the pin 12 will enter hole 63 and will lock the cam in the neutral position, which will be indicated by a suitable source such as a light in the control area, as a direct result of pin 12 coming in contact with microswitch 33 through roller 34. The cam 1 is maintained just high enough as to be always in a position to engage the rail 3 upon a very short drop. The rail clamp of the present invention can be used for securing movable structures such as movable bridges, cranes, stackers, reclaimers and the like so that these structures will not move uncontrollably or be displaced eventhrough adverse weather conditions may arise such as high winds and the like. The invention uses a double serrated cam 1 which is in direct contact with the rail 3 and the assembly has great holding power so that movable structures that travel on rails can be secured in place. The cam 1 engages the rail 3 over which the structure travels and the cam 1 is serrated or provided with teeth 39 and is double acting. Also, the cam can be lifted and will rotate, and the structure to be secured in place may be any type of device such as a coal and ore unloading bridge and tower, stacker, reclaimer or crane that travels on rails although the clamp can be used with other structures. The rail clamp of the present invention is intended primarily for the protection of movable structures and is confined between two struts 52 secured to the structure to accomodate the rail clamp. The entire rail clamp assembly slides along the rail with the cam 1 in a raised position ready to be dropped to clamp the structure.

The microswitches 37 located on brackets 43 signal in response to movement of roller 38, thus helping to center the cam 1 so that when the cam is lifted, it will move to a neutral position as the result of the inherent resiliency of the microswitches. The lifting devices, cylinder 25 or cylinder 44, provide for raising the cam above the rail when the structure is proceeding along the rail for performing its work and whenever the structure is at rest. The cam is dropped to its lowered position as shown in solid lines in FIG. 1 so that the flange 11 contacts the top of the rail 3. The cam stays in this position unless the structure is moved unintentionally, by bumping or by high winds to which these structures are very susceptible. In the act of moving, the struts 52 of the structure move the clamp body along the rail 3 and the cam 1 rolls along the rail because of its contact with the rail through the flange 11 and this brings the high side of the cam 1 to bear against the rail 3. This forces the rail 3 against the wearing shoe 4 and friction between the wearing shoe 4 and the rail 3 stops any further movement of the clamp along the rail.

The clamping device of the present invention is of simple construction and requires very little maintenance and the clamping device will secure the structure in place eventhough conditions may be wet, frosty, or icy or even if the rail 3 may be oily. When the structure is to be moved, the cam 1 is raised to clear the rail 3 and after the moving has been completed, the cam 1 is lowered so that the flange 11 rests on top of the rail 3. Then, any movement of the structure along the rail 3 will move the body of the clamp with it and the cam 1 will engage the rail due to friction between the flange 11 and the rail. If the forces tending to move the structure are great enough, the serrations or teeth 39 on the hard face of the cam 1 will impress themselves into the side of the rail 3 with enough force to gear the cam to the side of the rail. This cam, acting on one side of the rail, forces the rail against the wearing shoe 4 and the friction thus created will prevent any further movement of the clamping device and structure along the rail. This cam 1 is double acting, since it stops travel in either direction on the rail. The clamping device can be operated manually by disconnecting clevis 24. The cam 1 and tube 13 can be lifted and clevis 24 hooked into an emergency stowage bracket located on the structure and with enough elevation to maintain the cam 1 in the neutral position, or electrically, as shown in FIGS. 1 and 4 and only has to be lifted a short distance to be disengaged from the rail. Further, the cam is of a positive self-centering construction due to provision of the microswitches 37, which will help guide the flange 11 to rest on the rail 3. Also, the clamp frame or base 8 rides on top of the rail 3 to clean the rail of any obstruction such as ice or snow and the wearing shoe 4 on one side of the rail. When the clamp has become locked to the rail 3, it is released by reversing the travel of the structure. The direction needed to release the clamp will be indicated by a suitable source in the control area as a direct result of which microswitch 37 has come in contact with flange 15. Also, in the same manner, microswitch 33 will give position indication in the control area that the structure is ready for movement or can be used to tie into the circuits so that the structure can not be moved accidentially unless one of the microswitches 37 are engaged. At that time, an override would have to be energized in order to move the structure out of the locked cam 1 position.

The clamping jaw 1 in FIG. 4 is somewhat automatic since a loss of electrical energy to the valve 25 or valve 44 will allow the arm 18 to drop, thus engaging the flange 11 with the rail 3, whereby the cam is put in position to set or lock.

With the addition of microswitch 37, this invention will enable the structure operator to determine, at any specific period, if the structure, reclaimer, stacker, movable crane or bridge, has sustained any accidental movement. If any movement has occured, the structure operator can manipulate said structures in the opposite direction, as indicated by microswitch 37. This simple procedure allows cam 1 to be placed in the centering position.

Microswitch 33 provides a failsafe action to inform the structure operator of the raised position of cam 1, insuring that said structure is available for willed movement.

Cylinders 25 and 44 provide a stronger lifting action of tube 13 and cam 1 through arm 18 than any other device currently in existence. Thus, regardless of the environment in which cam 1 and tube 13 have been exposed; rusted post 2, snow or ice buildup between tube 13 and post 2, the added weight of loose debris on top of cam 1; movement of cam 1 will be insured.

I claim:

1. A cam operated rail clamping device for preventing movement of a vehicle on a rail comprising: a base; a vertically disposed post projecting upwardly from said base and secured thereto; a tubular member rotatably and slidably mounted on said post; means for raising said tubular member; a vertically disposed beam extending upwardly from said base and secured thereto; a horizontally disposed flange secured to the lower end of said tubular member; a clamping jaw carried by said flange and provided with a high point and a plurality of teeth for engagement with a first side of a rail; a wearing shoe carried by said base for engagement with a second side of said rail; said flange being mounted for rotation about said post to bring said high point of said jaw into wedging action with said first side of said rail when said flange engages a top portion of said rail, and means for positioning said clamping jaw in a lowered operative position and a raised inoperative position.

2. The device of claim 1, wherein said clamping jaw positioning means includes microswitches.

* * * * *